US006990699B2

(12) United States Patent
Hedges

(10) Patent No.: US 6,990,699 B2
(45) Date of Patent: Jan. 31, 2006

(54) THERAPEUTIC SUPPORT DEVICE

(76) Inventor: Charles Grant Hedges, 20872 Blue Water Dr., Spirit Lake, IA (US) 51360

( * ) Notice: Subject to any disclaimer, the term of this patent is extended or adjusted under 35 U.S.C. 154(b) by 0 days.

(21) Appl. No.: 10/800,355

(22) Filed: Mar. 15, 2004

(65) Prior Publication Data

US 2005/0198738 A1 Sep. 15, 2005

(51) Int. Cl.
*A47C 20/02* (2006.01)
*A61G 15/00* (2006.01)

(52) U.S. Cl. ..... 5/652; 5/630; 128/845
(58) Field of Classification Search ..... 5/636, 5/644, 645, 630, 652, 655.9, 491; 128/845
See application file for complete search history.

(56) References Cited

U.S. PATENT DOCUMENTS 3,719,185 A * 3/1973 Hanes ..... 606/240
3,842,453 A * 10/1974 Redfield ..... 5/643
4,081,870 A * 4/1978 Iannucci ..... 5/652
5,494,049 A * 2/1996 Rischbieth ..... 5/630
5,675,850 A * 10/1997 Schmitt ..... 5/630
5,824,013 A * 10/1998 Allen ..... 606/240

* cited by examiner

*Primary Examiner*—Michael Trettel
(74) *Attorney, Agent, or Firm*—Gary L. Huusko

(57) ABSTRACT

A therapeutic cylindrical support device, preferably made of foam or some other such flexible, compressible material, that works on a pneumatic basis whereby once a person's head, neck, back or any other body part is rested upon the device, the weight of the person will cause a small amount of air to discharge from the device and at the same time, maintain a comfortable level of firmness, thus providing the desired outcomes for the therapeutic results from the product.

3 Claims, 2 Drawing Sheets

THERAPEUTIC SUPPORT DEVICE

BACKGROUND

1. Field of Invention

The present invention relates generally to a therapeutic support device and more particularly to a therapeutic foam support device that is made of a material that is firm and flexible, that has a shape and design that both conforms comfortably to various portions of the human body having a curvature, thus providing supportive properties, and compresses against the muscle portions of a human body, thus providing relaxant properties.

2. Description of Prior Art

A variety of supportive "pillow-type" products have been used for many years to provide either orthopedic support or provide muscle-relaxing effects. The orthopedic support generally was for the lumbar or cervical areas of the back and spine. This was accomplished in prior art by use of air or liquid filled pillows, or pillow-type products that were filled with a variety of form-conforming fillers, such as grains, beads, and the like, or solid structures that offered no form-conforming properties, such as plastic or wood supports that may be shaped like a specific area of the body to which it was intended to apply.

There were a number of variations over the years made of wood and other products that were too stiff for using on the floor and other purposes. The disadvantage of those products are that they were too hard and did not provide comfort when the product is placed behind one's back for traveling, or when lying on the floor as a muscle relaxant behind one's neck to relieve stress. The materials used in the prior art either provided "give" yet were not firm enough to perform as an adequate support or muscle relaxant, or were too firm and didn't provide "give" necessary to conform to the affected body part to perform as a muscle relaxant. The wood products, for example, offer no "give" which makes those devices difficult and uncomfortable to use.

The current invention is also easy to make and inexpensive to make.

BRIEF SUMMARY OF INVENTION

The current invention provides for flexibility or "give" while maintaining firmness to provide both support and resilient muscle relaxant properties.

It is the principal object of this invention to provide an improved and superior orthopedic and muscle support therapeutic device. It is a further object of the current invention to provide stress relief.

It is a further object of this invention to provide an inexpensive yet effective therapeutic support and muscle relaxant.

There are many special types of pillows that have been developed but do not provide the same pneumatic air release to conform to one's body while providing a level of desired firmness.

Other objects and features of the current invention will become apparent from considerations of the following description taken in conjunction with the accompanying drawings.

DETAILED DESCRIPTION OF INVENTION

Figure 1:
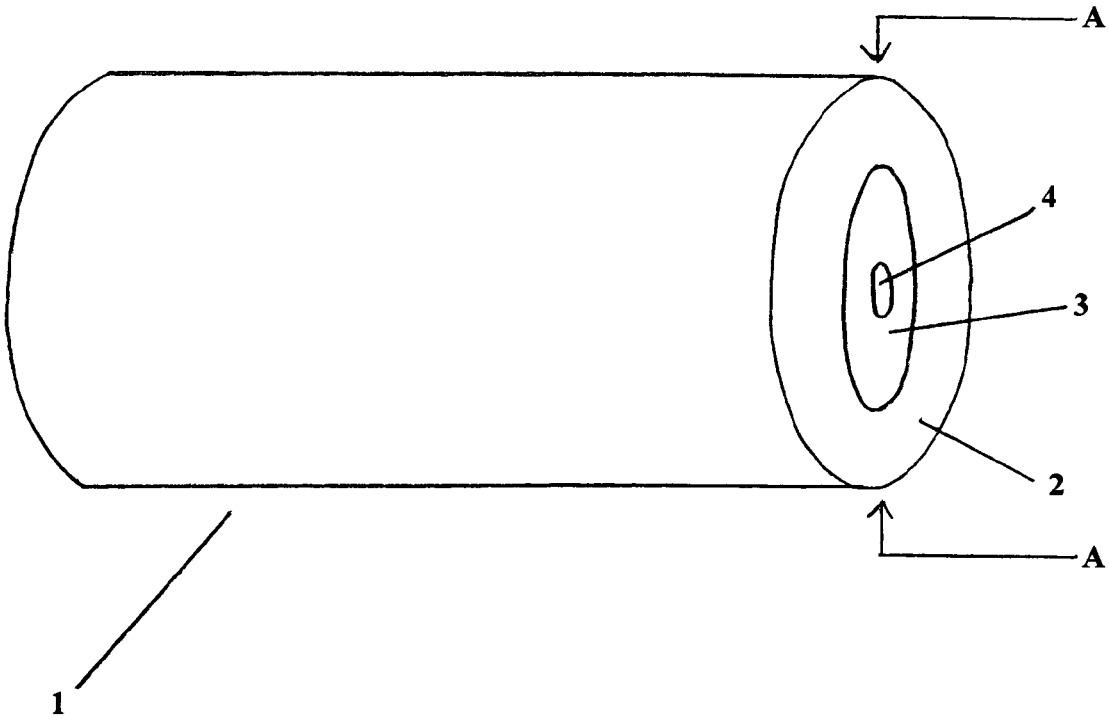
FIG. 1 is a perspective view of the preferred embodiment of the invention.

Referring first to FIG. 1, the device 1 has a main cylinder 2, hollowed out, and has two cylindrical plugs 3 that are glued and inserted into the main cylinder 2. The preferred embodiment would have the main cylinder 2 and the two cylindrical plugs 3 made out of foam or some other such flexible, compressible material. The hollowed main cylinder 2 has a length, two ends, an outer surface and an inner surface, the inner surface having a diameter of sufficient measure to allow for the insertion of two similar cylindrical plugs 3. Each cylindrical plug 3 has a length up to one-third of the length of the main cylinder 2 and two plug ends. Each cylindrical plug 3 also has an outer diameter of sufficient measure to allow each cylindrical plug 3 to be inserted into each of the two ends of the main cylinder 2. Each cylindrical plug 3 is thus inserted into the main cylinder 2 whereby one plug end is flush with the end of the main cylinder 2. The cylindrical plugs 3 can be held in place inside the main cylinder 2 with glue or some other adhesive means.

Figure 2:
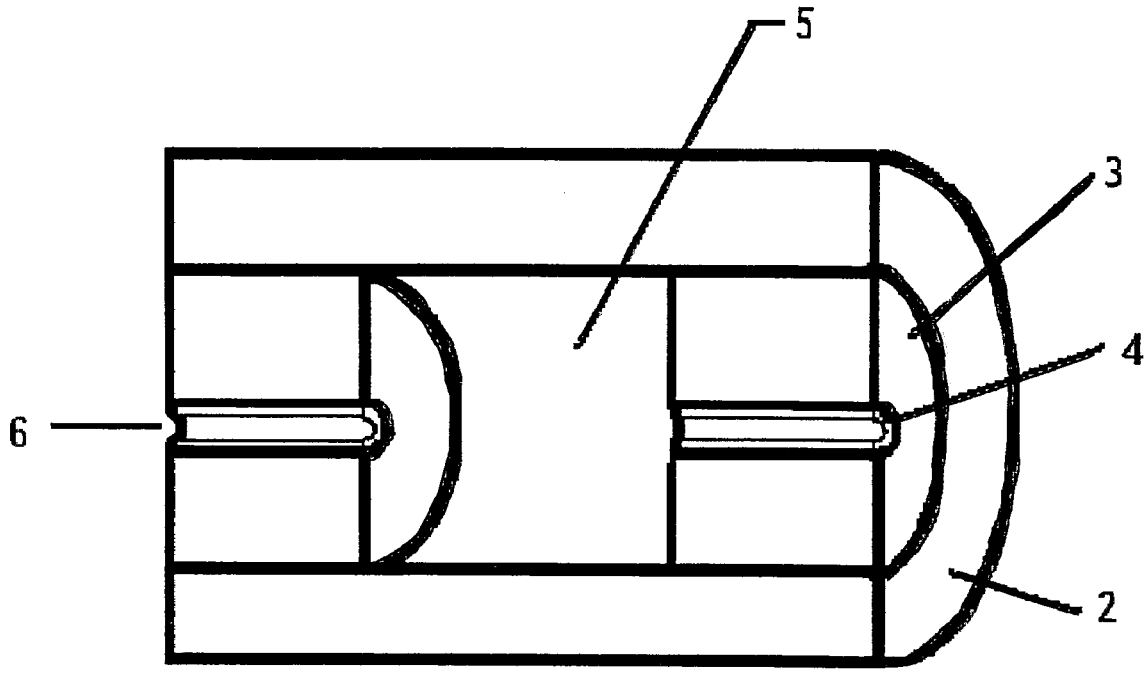
FIG. 2 is a cut-away view along line A of FIG. 1.

Referring now to FIG. 2, a small hole 6 is bored through the center of the two cylindrical plugs 3 and a hard piece of flexible piping 4 is inserted into the small hole 6 of each cylindrical plug 3. The preferred embodiment of the current invention would have the small hole 6 slightly less than a quarter of an inch and the hard pieces of piping 4 of approximately the same diameter. The hard pieces of piping 4 each have a length of up to one-third the length of the main cylinder 2. The cylindrical plugs 3, when inserted into the main cylinder 2 thus create a free air chamber 5 within the main cylinder 2, and the firm piping 4 thereby allows the air within the free air chamber 5 to be discharged from the device when the device is used, and also allows air to return to the free air chamber 5 once the device is no longer being used. The flexibility and resiliency of the foam used in the making of the device allows the device to return to its original form, thus drawing air back into the free air chamber 5.

In a second embodiment, the device can be manufactured in a one piece or two piece extrusion process, whereby the device would comprise a main cylinder 2 with a void within the interior of the main cylinder 2 acting as the free air chamber 5, said free air chamber 5 void located at the center of the main cylinder 2 and comprising one-third of the length of the main cylinder 2 and further comprising a diameter of one-half the diameter of the main cylinder 2, said main cylinder 2 further comprising two small diameter holes 6 at each end of the main cylinder 2 located at the center point of each such end, whereby when the main cylinder 2 is compressed, air would be able to flow out of the free air chamber 5 void through the two small holes 6, and when the main cylinder 2 is uncompressed, air would flow back into the free air chamber 5, again through the two small holes 6. The preferred embodiment would have the device 1 made out of foam or some other such flexible, compressible material.

The current invention works on a pneumatic basis whereby once a person's head, neck, back or any other body part is rested upon the device 1, the weight of the person will cause a small amount of air to discharge from the device 1 and at the same time, maintain a comfortable level of firmness, thus providing the desired outcomes for the therapeutic results from the product. Once the product is no longer in use, the air returns naturally to the center of the free air chamber 5 and the product is immediately ready for another purpose. Thus, the invention provides for support along its length while at the same time providing give at its center. The invention can be used for many purposes, such as providing stress and therapeutic relief on one's back by lying on the device on the floor, behind one's neck while viewing television, working in an office chair, an automobile, airplane and many other uses. It could further be used for kneeling upon, such as in performing gardening or construction work, and can be used for camping and many, many other recreational uses.

A preferred embodiment would have the user placing the device 1 against his or her back, aligning the center of the device 1 with the user's spine. The device 1 compresses, allowing air to escape the free air chamber 5 thus allowing the device 1 to conform to the user's back, putting pressure on the muscles of the back without adding pressure or strain to the user's spine.

I claim:

1. A therapeutic support, comprising:

a main cylinder having a length, two ends, and a hollow center forming an inner diameter, two similar cylindrical plugs fixedly inserted into the main cylinder, each having a length, an outer diameter, a small hole bore and two plug ends, said length of the cylindrical plugs being up to one-third the length of the main cylinder, said outer diameter of the cylindrical plugs having sufficient measure to abut the inner diameter of the main cylinder upon insertion of the cylindrical plugs into the main cylinder thereby creating a free air chamber within the hollow center of the main cylinder, two pieces of flexible firm piping, each said flexible firm piping having a length, said length being up to one-third the length of the main cylinder and each said flexible firm piping being fixedly inserted into the small hole bores of each cylindrical plug, adhesive means to attach the cylindrical plugs to the main cylinder, and adhesive means to attach the flexible firm piping to the small hole bore, whereby once a person rests any other body part on the therapeutic support, the weight of the person will cause a small amount of air to discharge from the free air chamber through the firm piping and at the same time maintain a level of firmness that provides the desired outcomes for the therapeutic results from the product, and further allows for the air to return naturally to the free air chamber once the use is over, whereby the therapeutic support is immediately ready for another use and purpose.

2. The apparatus of claim 1 wherein the main cylinder and cylindrical plugs are made of foam.

3. A therapeutic support made of foam, comprising:

a main cylinder having a length, a middle third portion, two end third portions, a first outer diameter, and a hollow center, said hollow center being in said middle third portion and further comprising a second inner diameter, said hollow center second inner diameter being one-half of the first outer diameter, two end third portion bores situated within said two end third portions and extending from the hollow center through the two end third portions, said two end third portions having end faces and end face centers wherein the two end third portion bores are located at the end face centers, said two end third portion bores having a one-quarter inch third diameter, whereby once a person rests any other body part on the therapeutic support, the weight of the person will cause a small amount of air to discharge from the hollow center through the two end third portion bores and at the same time maintain a level of firmness that provides the desired outcomes for the therapeutic results from the product, and further allows for the air to return naturally to the hollow center once the use is over, whereby the therapeutic support is immediately ready for another use and purpose.

* * * * *